US010768558B2

(12) United States Patent
Mandai et al.

(10) Patent No.: US 10,768,558 B2
(45) Date of Patent: Sep. 8, 2020

(54) IMAGE FORMATION APPARATUS

(71) Applicant: Konica Minolta, Inc., Chiyoda-ku, Tokyo (JP)

(72) Inventors: Yuusuke Mandai, Kyoto (JP); Kanji Nakayama, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/012,505

(22) Filed: Jun. 19, 2018

(65) Prior Publication Data

US 2018/0373182 A1 Dec. 27, 2018

(30) Foreign Application Priority Data

Jun. 22, 2017 (JP) ..... 2017-122036

(51) Int. Cl.

| | |
|---|---|
| ***G03G 15/16*** | (2006.01) |
| ***G03G 15/00*** | (2006.01) |
| ***G03G 21/14*** | (2006.01) |
| *G03G 15/06* | (2006.01) |

(52) U.S. Cl.

CPC ..... *G03G 15/1675* (2013.01); *G03G 15/5037* (2013.01); *G03G 21/14* (2013.01); *G03G 15/065* (2013.01)

(58) Field of Classification Search

CPC ..... G03G 15/1675
USPC ..... 399/45
See application file for complete search history.

(56) References Cited

U.S. PATENT DOCUMENTS

| | | | | |
|---|---|---|---|---|
| 6,449,444 | B1 * | 9/2002 | Tanaka | G03G 15/1675 399/313 |
| 2002/0168193 | A1 * | 11/2002 | Weaver | B65H 43/00 399/45 |
| 2016/0147182 | A1 * | 5/2016 | Yokoyama | G03G 15/1665 399/44 |

FOREIGN PATENT DOCUMENTS

| | | |
|---|---|---|
| JP | 2003-287966 A | 10/2003 |
| JP | 2010-276668 A | 12/2010 |

* cited by examiner

*Primary Examiner* — Quana Grainger
(74) *Attorney, Agent, or Firm* — Squire Patton Boggs (US) LLP

(57) ABSTRACT

An image formation apparatus includes a first electrode portion including a contact electrode and a counter electrode, a second electrode portion arranged as not being in contact with a recording medium, a first sensing unit configured to sense a first current which flows to the first electrode portion as a result of application of a voltage across the contact electrode and the counter electrode while the recording medium lies between the contact electrode and the counter electrode, a second sensing unit configured to sense a second current which flows from the charged recording medium to the second electrode portion, and a control unit. The control unit sets a transfer condition for transferring a toner image to the recording medium based on the first current sensed by the first sensing unit and the second current sensed by the second sensing unit.

6 Claims, 12 Drawing Sheets

| THICKNESS OF PAPER [m] | ELECTRICAL RESISTANCE OF PAPER [Ω] |
|---|---|
| 5.0E-05 | 2.E+09 |
| 1.0E-04 | 6.E+08 |
| 1.5E-04 | 5.E+08 |

FIG.7

| THICKNESS OF PAPER [m] | ELECTRICAL RESISTANCE OF PAPER [Ω] | SECONDARY TRANSFER CURRENT [μA] | DISCHARGED CURRENT [μA] |
|---|---|---|---|
| 5.0E−05 | 2.E+09 | 145.5 | 0.0 |
| 1.0E−04 | 6.E+08 | 145.3 | 16.3 |
| 1.5E−04 | 5.E+08 | 145.7 | 30.8 |

FIG.8

| VOLTAGE [V] | THICKNESS OF PAPER [m] | CAPACITANCE [F/m$^2$] | ELECTRICAL RESISTANCE [Ω] | SECONDARY TRANSFER CURRENT [μA] | DISCHARGED CURRENT [μA] |
|---|---|---|---|---|---|
| V1 | T1 | Q1 | R1 | TI1 | RI1 |
| ⋮ | ⋮ | ⋮ | ⋮ | ⋮ | ⋮ |
| Vn | Tn | Qn | Rn | TIn | RIn |

FIG.11

| MEASURED ITEM | | SENSED ITEM (PHYSICAL PROPERTIES OF PAPER) | | TRANSFER CONDITION AND COOLING CONDITION | | |
|---|---|---|---|---|---|---|
| SECONDARY TRANSFER CURRENT [μA] | DISCHARGED CURRENT [μA] | ELECTRICAL RESISTANCE OF PAPER [Ωm$^2$] | CAPACITANCE [F/m$^2$] | SECONDARY TRANSFER BIAS [V] | COOLING OF PAPER | PROCESS SPEED |
| 10.1 | 0.3 | 1.50E+06 | 3.5E−07 | 3000 | NONE | FULL SPEED |
| 9.4 | 5.3 | 1.50E+06 | 1.8E−07 | 3200 | NONE | FULL SPEED |
| 9.2 | 9.2 | 1.50E+06 | 1.2E−07 | 3300 | NONE | FULL SPEED |
| 9.9 | 0.1 | 1.80E+06 | 3.5E−07 | 3000 | NONE | FULL SPEED |
| 9.1 | 4.9 | 1.80E+06 | 1.8E−07 | 3300 | INTERMEDIATE | FULL SPEED |
| 8.8 | 8.7 | 1.80E+06 | 1.2E−07 | 3300 | NONE | HALF SPEED |
| 9.0 | 0.0 | 6.00E+06 | 3.5E−07 | 3300 | HIGH | FULL SPEED |
| 7.5 | 1.3 | 6.00E+06 | 1.8E−07 | 4000 | HIGH | FULL SPEED |
| 6.7 | 3.2 | 600E+06 | 1.2E−07 | 4000 | NONE | 1/3 SPEED |

FIG.15

| CAPACITANCE [F] | RESISTANCE [Ω] | SECONDARY TRANSFER CURRENT [μA] | DISCHARGED CURRENT [μA] | SECONDARY TRANSFER VOLTAGE [V] | THE NUMBER OF ROTATIONS OF COOLING FAN |
|---|---|---|---|---|---|
| 3.50E-07 | 1.00E+07 | 197 | 0 | 2400 | ZERO |
| 3.50E-07 | 2.00E+09 | 145 | 0 | 3500 | HIGH |
| 1.80E-07 | 6.00E+08 | 145 | 16 | 3300 | INTERMEDIATE |
| 1.20E-07 | 5.00E+08 | 146 | 31 | 3100 | INTERMEDIATE |
| 1.20E-07 | 2.00E+08 | 170 | 29 | 2800 | LOW |

IMAGE FORMATION APPARATUS

The entire disclosure of Japanese Patent Application No. 2017-122036 filed on Jun. 22, 2017 is incorporated herein by reference in its entirety.

BACKGROUND

Technological Field

The present invention relates to an image formation apparatus.

Description of the Related Art

In transfer of a toner image to paper in an electrophotographic process, in general, a bias is applied across an image carrier or an intermediate transfer element and paper so that toner is transferred owing to static electricity. Intensity of electric field applied to the toner has been known to be affected by electrical properties of paper such as a capacitance and an electrical resistance.

In order to adjust a transfer bias in accordance with difference in paper, a method of setting a transfer bias in accordance with paper information (a type or a basis weight) set by a user has been put into practical use. In recent years, in order to improve convenience of a user, a method of mounting a sensor configured to sense physical properties of paper and setting a transfer bias in accordance with sensing information from the sensor has been put into practical use.

These methods, however, suffer from the following problems. Though paper information such as a basis weight set by a user relates to some extent to electrical properties of paper which affect transfer, it is not directly relevant to a dielectric constant or a resistance and hence an appropriate transfer bias cannot be set in some cases. In some cases, since a user is unable to determine paper information or does not set paper information, an appropriate transfer bias cannot be set.

When a sensor configured to sense physical properties of paper is employed, cost for sensing increases and a space for installation of the sensor is required as compared with a conventional example.

In order to address the problems above, an image formation apparatus disclosed in Japanese Laid-Open Patent Publication No. 2003-287966 estimates an electrical resistance or a capacitance of paper based on a transfer current.

An image formation apparatus disclosed in Japanese Laid-Open Patent Publication No. 2010-276668 estimates an electrical resistance or a capacitance of paper based on a discharged current.

SUMMARY

In the image formation apparatus disclosed in Japanese Laid-Open Patent Publication No. 2003-287966, however, when a current is low, one cannot distinguish simply based on a transfer current alone, whether the low current is caused by a high resistance of paper or a low capacitance of the paper.

In the image formation apparatus disclosed in Japanese Laid-Open Patent Publication No. 2010-276668, a voltage to be applied is determined based on a sensed discharged current by preparing a table for each of a selected type of paper (plain paper/cardboard) and a humidity. The discharged current, however, is affected by a secondary transfer current, and therefore, under constant voltage control generally employed in secondary transfer, the secondary transfer current varies depending on a type of paper. Then, the discharged current also varies. Therefore, depending on a type of paper, a proper voltage cannot be set based on the prepared table.

The present invention was made in view of the problems as above, and an object of the present invention is to provide an image formation apparatus capable of accurately setting a transfer condition in transfer of a toner image to a recording medium.

To achieve at least one of the abovementioned objects, according to an aspect of the present invention, an image formation apparatus reflecting one aspect of the present invention comprises a first electrode portion including a contact electrode and a counter electrode, the contact electrode being in contact with a transported recording medium, the counter electrode being arranged to be opposed to the contact electrode such that the transported recording medium lies between the contact electrode and the counter electrode, a second electrode portion arranged as not being in contact with the recording medium such that charges applied to the recording medium are movable, a first sensing unit configured to sense a first current which flows to the first electrode portion as a result of application of a voltage across the contact electrode and the counter electrode while the recording medium lies between the contact electrode and the counter electrode, a second sensing unit configured to sense a second current which flows from the charged recording medium to the second electrode portion, and a control unit configured to receive input of results of sensing by the first sensing unit and the second sensing unit. The control unit is configured to set a transfer condition for transferring a toner image to the recording medium based on the first current sensed by the first sensing unit and the second current sensed by the second sensing unit.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 7 is a diagram showing one example of a thickness of paper and an electrical resistance of the paper which are specified from a secondary transfer current and a discharged current.

FIG. 8 is a diagram showing one example of a table used in calculation of physical properties of paper in the image formation apparatus according to the embodiment.

FIG. 11 is a diagram showing one example of physical properties of paper calculated from a secondary transfer current and a discharged current measured with a first sensing unit and a second sensing unit as well as a transfer condition and a cooling condition determined based on the physical properties of the paper according to the embodiment.

FIG. 15 is a diagram showing one example of a table that is used in determining physical properties of paper, a transfer condition, and a cooling condition based on a secondary transfer current and a discharged current sensed by the first sensing unit and the second sensing unit according to the embodiment.

DETAILED DESCRIPTION OF EMBODIMENTS

Figure 1:
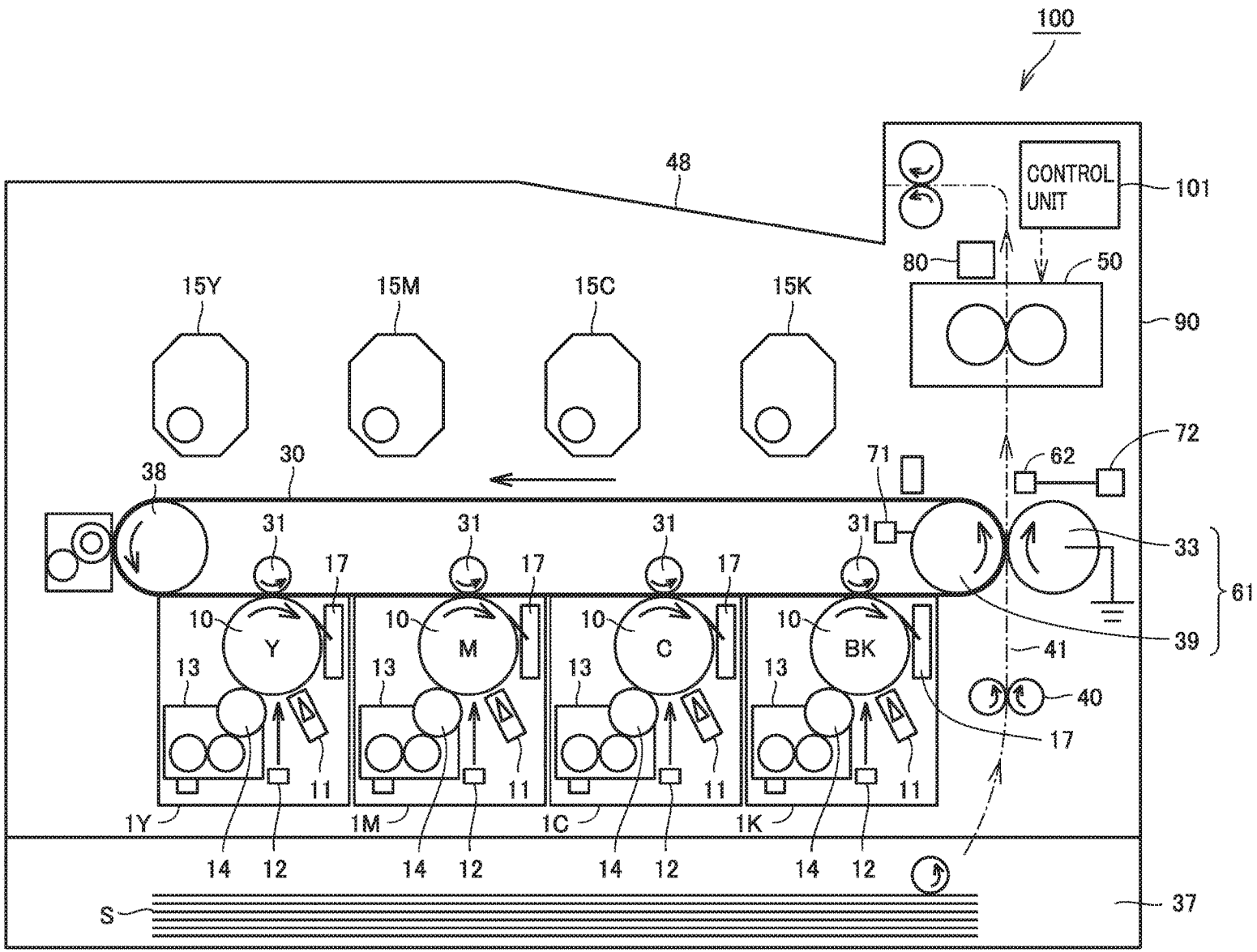
FIG. 1 is a schematic diagram of an image formation apparatus according to an embodiment.

Hereinafter, one or more embodiments of the present invention will be described with reference to the drawings. However, the scope of the invention is not limited to the disclosed embodiments.

The same or common elements in the embodiment shown below have the same reference characters allotted in the drawings and description thereof will not be repeated.

FIG. 1 is a schematic diagram of an image formation apparatus according to an embodiment. An image formation apparatus 100 will be described with reference to FIG. 1.

FIG. 1 shows image formation apparatus 100 as a color printer. Though image formation apparatus 100 as the color printer is described below, image formation apparatus 100 is not limited to the color printer. For example, image formation apparatus 100 may be a monochrome printer, a facsimile machine, or a multi-functional peripheral (M P) of a monochrome printer, a color printer, and a facsimile machine as being combined.

Image formation apparatus 100 includes image formation units 1Y, 1M, 1C, and 1K, an intermediate transfer belt 30, a primary transfer roller 31, a secondary transfer roller 33, a cassette 37, a driven roller 38, a drive roller 39, a timing roller 40, a fixation apparatus 50, a cooling apparatus 80, a housing 90, and a control unit 101. Secondary transfer roller 33 and drive roller 39 function as a secondary transfer apparatus 61.

Image formation apparatus 100 includes secondary transfer apparatus 61 as a first electrode portion, an electricity removal electrode 62 as a second electrode portion, a first sensing unit 71, and a second sensing unit 72.

Secondary transfer apparatus 61 is set to sandwich a transported recording medium and configured to receive application of a voltage. Electricity removal electrode 62 is arranged as not being in contact with the recording medium such that applied charges are movable. Electricity removal electrode 62 is arranged downstream from secondary transfer apparatus 61 in a direction of transportation of the recording medium.

First sensing unit 71 senses a first current which flows to secondary transfer apparatus 61. Second sensing unit 72 senses a second current which flows from the recording medium to electricity removal electrode 62. First sensing unit 71 and second sensing unit 72 are each implemented, for example, by a current sensor. Results of sensing by first sensing unit 71 and second sensing unit 72 are input to control unit 101.

An image formation portion is constituted of image formation units 1Y, 1M, 1C, and 1K, intermediate transfer belt 30, primary transfer roller 31, secondary transfer roller 33, cassette 37, driven roller 38, drive roller 39, and timing roller 40. The image formation portion forms a toner image on paper S as a recording medium which is transported along a transportation path 41 which will be described later.

Image formation units 1Y, 1M, 1C, and 1K are sequentially aligned along intermediate transfer belt 30. Image formation unit 1Y forms a toner image of yellow (Y) upon receiving supply of toner from a toner bottle 15Y. Image formation unit 1M forms a toner image of magenta (M) upon receiving supply of toner from a toner bottle 15M. Image formation unit 1C forms a toner image of cyan (C) upon receiving supply of toner from a toner bottle 15C. Image formation unit 1K forms a toner image of black (BK) upon receiving supply of toner from a toner bottle 15K.

Image formation units 1Y, 1M, 1C, and 1K are arranged sequentially in a direction of rotation of intermediate transfer belt 30 along intermediate transfer belt 30. Each of image formation units 1Y, 1M, 1C, and 1K includes a photoconductor 10, a charging apparatus 11, an exposure apparatus 12, a development apparatus 13, and a cleaning apparatus 17.

Charging apparatus 11 evenly charges a surface of photoconductor 10. Exposure apparatus 12 irradiates photoconductor 10 with laser beams in response to a control signal from control unit 101 and exposes the surface of photoconductor 10 in accordance with an input image pattern. An electrostatic latent image in accordance with an input image is thus formed on photoconductor 10.

Development apparatus 13 applies a development bias to a development roller 14 while it rotates development roller 14, to thereby attach toner onto a surface of development roller 14. The toner is thus transferred from development roller 14 to photoconductor 10 and a toner image in accordance with the electrostatic latent image is developed on the surface of photoconductor 10.

Photoconductor 10 and intermediate transfer belt 30 are in contact with each other at a portion where primary transfer roller 31 is provided. Primary transfer roller 31 is in a shape of a roller and configured to be rotatable. A transfer voltage opposite in polarity to the toner image is applied to primary transfer roller 31 so that the toner image is transferred from photoconductor 10 to intermediate transfer belt 30. The toner image of yellow (Y), the toner image of magenta (M), the toner image of cyan (C), and the toner image of black (BK) are successively layered and transferred from photoconductor 10 to intermediate transfer belt 30. The color toner image is thus formed on intermediate transfer belt 30.

Intermediate transfer belt 30 is looped around driven roller 38 and drive roller 39. Drive roller 39 is rotationally driven, for example, by a motor (not shown). Intermediate transfer belt 30 and driven roller 38 rotate in coordination with drive roller 39. A toner image on intermediate transfer belt 30 is thus transported to secondary transfer roller 33.

Cleaning apparatus 17 is pressed against photoconductor 10 as being in contact therewith. Cleaning apparatus 17 recovers toner which remains on the surface of photoconductor 10 after transfer of the toner image.

Paper S is set in cassette 37. Paper S is sent from cassette 37 to secondary transfer roller 33 one by one along transportation path 41 by timing roller 40. Secondary transfer roller 33 is in a shape of a roller and configured to be rotatable. Secondary transfer roller 33 applies a transfer voltage opposite in polarity to the toner image to transported paper S.

The toner image is thus attracted from intermediate transfer belt 30 to secondary transfer roller 33 and the toner image on intermediate transfer belt 30 is transferred to paper S. Timing of transportation of paper S to secondary transfer roller 33 is adjusted by timing roller 40 in accordance with a position of the toner image on intermediate transfer belt 30. Owing to timing roller 40, the toner image on intermediate transfer belt 30 is transferred to an appropriate position on paper S.

When a voltage is applied across drive roller 39 and secondary transfer roller 33 in thus transferring a toner image to paper S, a first current flows from secondary transfer roller 33 through paper S toward drive roller 39. This first current is sensed by first sensing unit 71.

In secondary transfer, charges are accumulated in paper S. Charges accumulated in paper S move toward the second electrode arranged in proximity to paper S while the paper is transported along the transportation path. A second current thus flows to electricity removal electrode 62. The second current is sensed by second sensing unit 72.

Control unit 101 sets a transfer condition for transfer of a toner image to paper S based on the first current sensed by first sensing unit 71 and the second current sensed by second sensing unit 72.

Fixation apparatus 50 pressurizes and heats paper S which passes therethrough. The toner image is thus fixed onto paper S. Fixation apparatus 50 thus fixes the toner image onto paper S transported along transportation path 41. Paper S on which the toner image has been fixed is ejected onto a tray 48.

Though image formation apparatus 100 adopting a tandem system as a printing method has been described above, a printing method of image formation apparatus 100 is not limited to the tandem system. Arrangement of each feature in image formation apparatus 100 can be modified as appropriate in accordance with an adopted printing method. A rotary system or a direct transfer system may be adopted as the printing method of image formation apparatus 100. In the rotary system, image formation apparatus 100 is constituted of a single photoconductor 10 and a plurality of development apparatuses 13 configured to be rotatable on the same axis. Image formation apparatus 100 sequentially guides each development apparatus 13 to photoconductor 10 during printing and develops a toner image of each color. In the direct transfer system, image formation apparatus 100 directly transfers a toner image formed on photoconductor 10 onto paper S.

Figure 2:
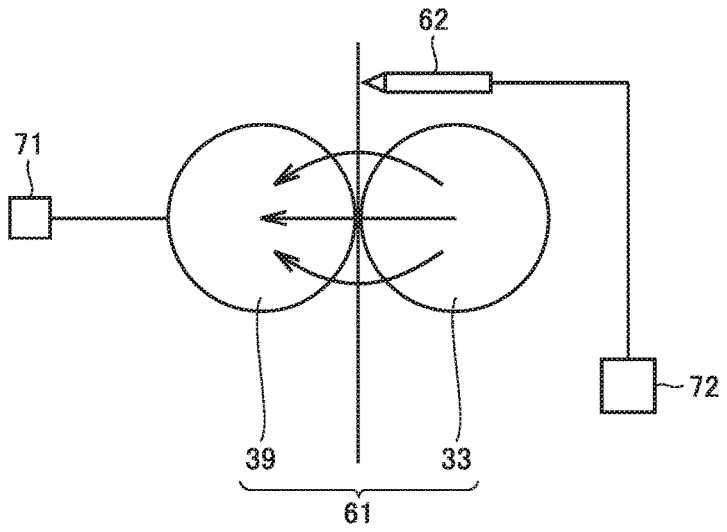
FIG. 2 is a schematic diagram showing a peripheral structure of a secondary transfer apparatus according to the embodiment.

FIG. 2 is a schematic diagram showing a peripheral structure of the secondary transfer apparatus according to the embodiment. The peripheral structure of the secondary transfer apparatus according to the embodiment will be described with reference to FIG. 2.

As shown in FIG. 2, the secondary transfer apparatus is constituted of secondary transfer roller 33 as a contact electrode and drive roller 39 as a counter electrode. Secondary transfer roller 33 is in contact with a transported recording medium. Secondary transfer roller 33 functions as the contact electrode. Drive roller 39 is arranged to be opposed to secondary transfer roller 33 such that the recording medium lies between the drive roller and the secondary transfer roller.

Secondary transfer roller 33 and drive roller 39 are each constituted, for example, of a core metal and a surface layer. The core metal is made of aluminum or iron and is in a shape of a pipe. The surface layer is made, for example, of an ion conductive rubber material. For example, nitrile rubber (NBR) and epichlorohydrin rubber (ECO) can be used as being blended as the ion conductive rubber material. Drive roller 39 is rotationally driven by a drive source (not shown). Intermediate transfer belt 30 is made, for example, of a polyimide film.

By applying a voltage across secondary transfer roller 33 and drive roller 39 while paper lies between secondary transfer roller 33 and drive roller 39, a secondary transfer current as the first current flows to secondary transfer roller 33 and drive roller 39.

As an electrical resistance of paper S is lower, more secondary transfer current flows. As a capacitance of paper S is higher, more secondary transfer current flows.

The secondary transfer current flows through two paths below. The first path is a path which passes through a transfer nip portion defined by secondary transfer roller 33 and drive roller 39. The second path is a path which passes through a gap provided between secondary transfer roller 33 and drive roller 39 upstream and downstream from the transfer nip portion in the direction of transportation of paper S.

The current which flows through the first path flows in accordance with an electrical resistance on the first path (an electrical resistance of each roller, an electrical resistance of paper S, and an electrical resistance of intermediate transfer belt 30) with respect to a transfer bias applied to secondary transfer roller 33. Namely, the current flows under the Ohm's law. Therefore, as an electrical resistance of paper S is lower, more current flows.

The current which flows through the second path flows owing to discharging. In order to cause discharging in the gap, a voltage not lower than a certain level (the Paschen's law) is required, and as a capacitance of paper is higher, a potential loss in paper is less. A potential difference in the gap is thus greater and discharging is more likely to occur. Therefore, as a capacitance of paper is higher, more current flows.

Figure 3:
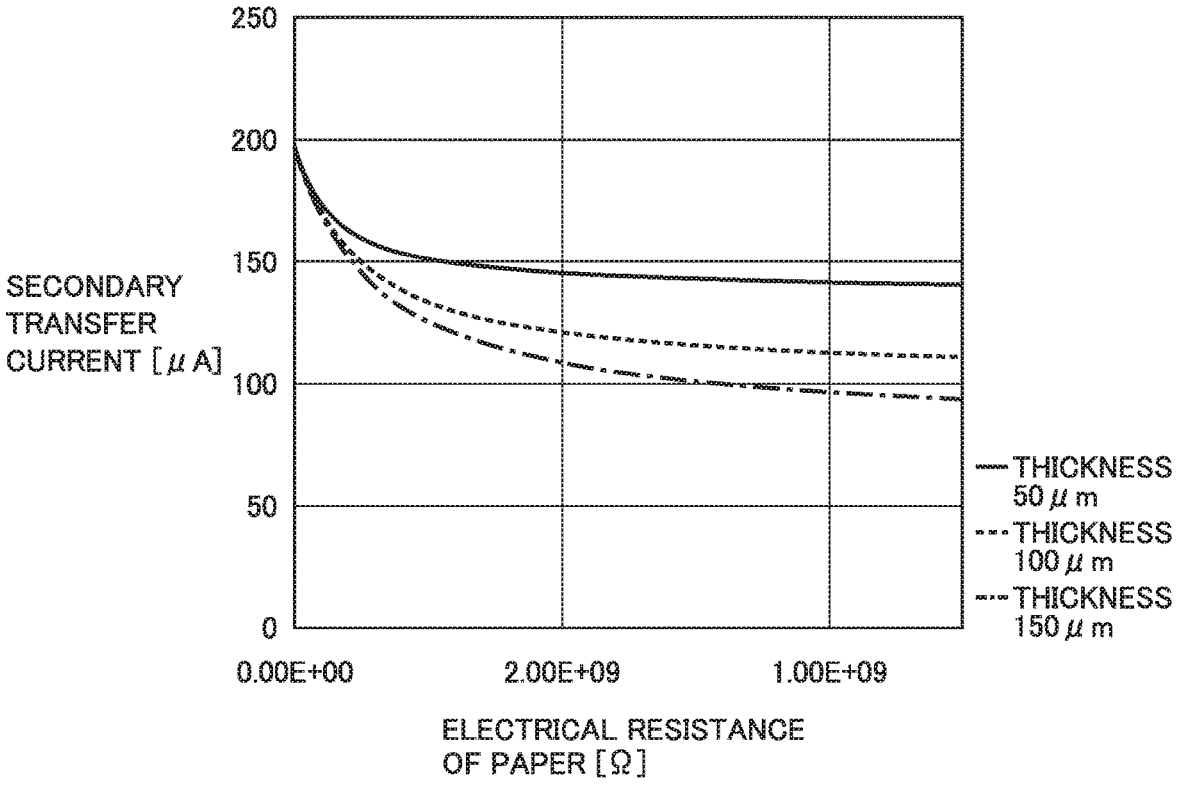
FIG. 3 is a diagram showing relation between a secondary transfer current which flows to the secondary transfer apparatus and an electrical resistance of paper according to the embodiment.

FIG. 3 is a diagram showing relation between a secondary transfer current which flows to the secondary transfer apparatus and an electrical resistance of paper according to the embodiment. Relation between a secondary transfer current which flows to the secondary transfer apparatus and an electrical resistance of paper will be described with reference to FIG. 3.

FIG. 3 shows a secondary transfer current sensed by first sensing unit 71 when paper S passes through the secondary transfer apparatus, with electrical resistances of three types of paper S having thicknesses of 50 μm, 100 μm, and 150 μm, respectively, being varied as appropriate.

A process speed in passage through the secondary transfer apparatus is set, for example, to 100 mm/s, and a secondary transfer voltage applied to the secondary transfer apparatus (more specifically, across secondary transfer roller 33 and drive roller 39) is set, for example, to approximately 3000 V. Intermediate transfer belt 30 made of a polyimide film has a thickness, for example, of 130 μm and has a volume resistance of approximately 1E3Ω. Ion conductive rubber used for a surface layer of secondary transfer roller 33 has a thickness, for example, of 3 mm and has a volume resistance of approximately 1E5Ω.

As shown in FIG. 3, in a region where an electrical resistance of paper S is low, a secondary transfer current varies in accordance with an electrical resistance. In the region where an electrical resistance of paper S is low, a current which flows to a secondary transfer nip portion is dominant.

In a region where an electrical resistance of paper S is relatively low, a constant current flows regardless of a thickness of paper S. In this case, an electrical resistance of paper S is low, and an electrical resistance of intermediate transfer belt 30 and electrical resistances of secondary transfer roller 33 and drive roller 30 are relatively high, which are hence dominant.

On the other hand, in a region where an electrical resistance of paper S is high, the secondary transfer current is not much dependent on various electrical resistances but is dependent on a thickness, that is, on a capacitance, of paper S.

When the secondary transfer nip portion has a width of 5 mm, with the process speed of 100 mm/s, paper S passes through the secondary transfer nip portion in 1/20 second. Therefore, even though a bias of 3000 V set as a secondary transfer voltage is applied to paper S, with an electrical resistance not lower than 1E9Ω, only at most 3 μA of current flows. The current resulting from discharging is rather dominant in the region where the electrical resistance of paper S is high. Therefore, the secondary transfer current is significantly affected by a thickness of paper, that is, by a capacitance of the paper.

Figures 4, 5:
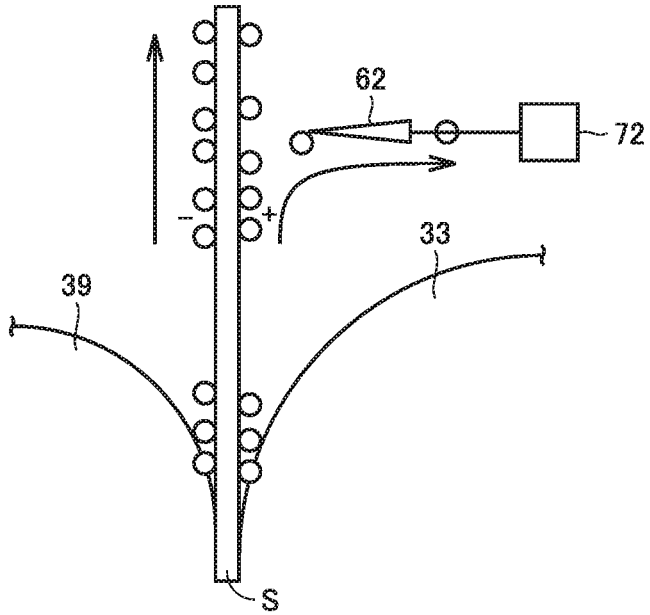
FIG. 4 is a diagram showing one example of a thickness of paper and an electrical resistance of the paper when a secondary transfer current is set to 145 μA in the relation shown in FIG. 3.
FIG. 5 is a schematic diagram showing a peripheral structure of an electricity removal electrode according to the embodiment.

FIG. 4 is a diagram showing one example of a thickness of paper and an electrical resistance of the paper when the secondary transfer current is set to 145 μA in the relation shown in FIG. 3. One example of a thickness of paper and an electrical resistance of the paper when the secondary transfer current is set to a prescribed value will be described with reference to FIG. 4.

Three sets as shown in FIG. 4 represent examples of a thickness of paper (a capacitance of paper) and an electrical resistance of the paper when a secondary transfer current is set to 145 μA. Therefore, it is difficult, only with a secondary transfer current sensed by first sensing unit 71, to accurately estimate physical properties (a capacitance and an electrical resistance) of paper.

In the present embodiment, second sensing unit 72 is configured to sense a discharged current as the second current which flows to electricity removal electrode 62.

FIG. 5 is a schematic diagram showing a peripheral structure of the electricity removal electrode according to the embodiment. The peripheral structure of the electricity removal electrode according to the embodiment will be described with reference to FIG. 5.

As shown in FIG. 5, paper S which has passed through the secondary transfer nip portion defined between secondary transfer roller 33 and drive roller 39 is charged as a result of application of a high voltage across secondary transfer roller 33 and drive roller 39 in secondary transfer.

The discharged current which flows from charged paper S to electricity removal electrode 62 owing to discharging is dependent on an amount of charges in paper S and a capacitance of the paper. Since an amount of charges in paper S resulting from charging is basically equal to an amount of charges applied in secondary transfer, it is dependent on an amount of secondary transfer current. The amount of charges in paper S owing to charging is dependent on an electrical resistance and a capacitance of paper S.

An amount of charges held in paper S owing to charging until the charges reach electricity removal electrode 62 is important. Since secondary transfer apparatus 61 according to the embodiment is of a transfer roller type, charges substantially equal in amount and different in polarity are applied to a front surface and a rear surface of paper in the secondary transfer nip portion.

Therefore, when the electrical resistance of paper S is low, charges on the front surface and the rear surface are removed by the time the charges reach electricity removal electrode 62 after secondary transfer and hence the discharged current becomes less.

Electricity removal electrode 62 is arranged on a rear surface side of paper S, and discharging to electricity removal electrode 62 does not occur until a potential difference between the rear surface of paper S and electricity removal electrode 62 is equal to or greater than a potential at a prescribed value. A potential produced by the charges accumulated in paper S is dependent on an electrostatic distance between paper S and electricity removal electrode 62.

Charges different in polarity are present on the front surface and the rear surface of paper S as described above. Therefore, when the electrostatic distance between charges different in polarity is short, there will be no large potential difference. When an electrostatic distance between charges in paper different in polarity is long, a potential difference will become greater. As an electrostatic distance between the front surface and the rear surface of the paper is longer, that is, a capacitance of the paper is lower, a discharged current is higher.

Figure 6:
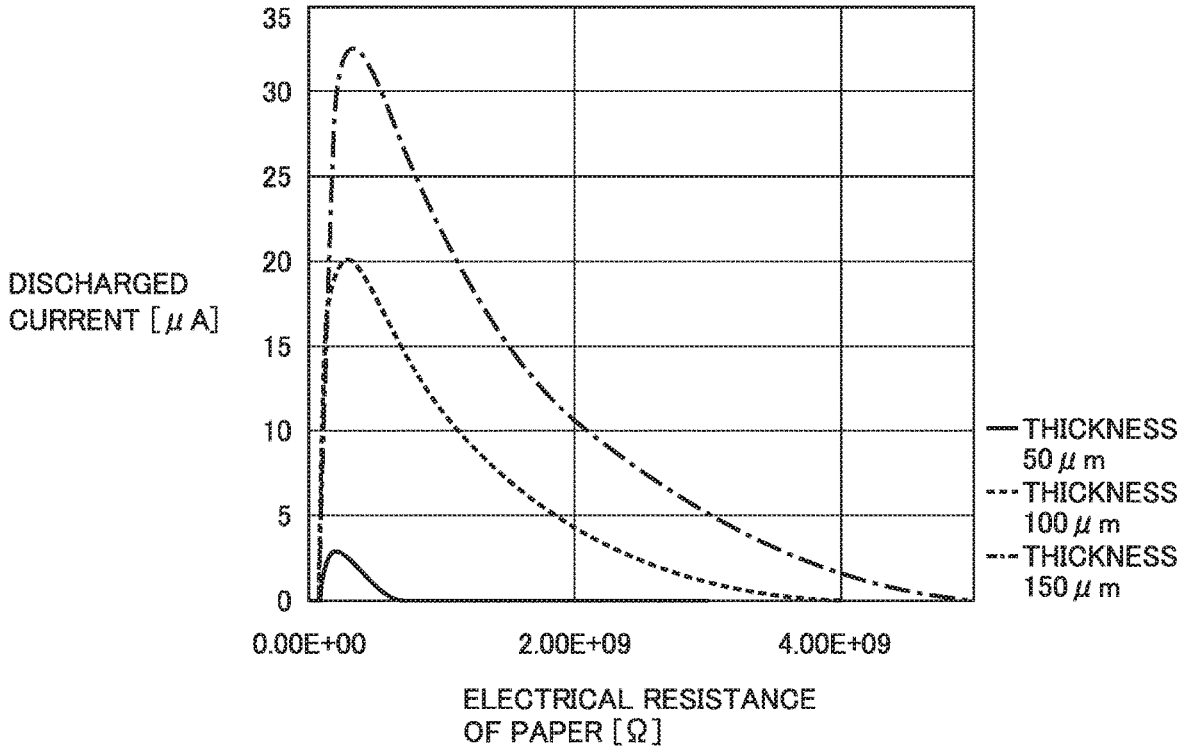
FIG. 6 is a diagram showing relation between a discharged current which flows to the electricity removal electrode and an electrical resistance of paper according to the embodiment.

FIG. 6 is a diagram showing relation between a discharged current which flows to the electricity removal electrode and an electrical resistance of paper according to the embodiment. Relation between a discharged current which flows to the electricity removal electrode and an electrical resistance of paper according to the embodiment will be described with reference to FIG. 6.

FIG. 6 shows a discharged current which flows from paper S to electricity removal electrode 62 and is sensed by second sensing unit 72 after paper S has passed through the secondary transfer apparatus, with electrical resistances of three types of paper S having thicknesses of 50 μm, 100 μm, and 150 μm, respectively, being varied as appropriate.

A process speed in passage through the secondary transfer apparatus is set, for example, to 100 mm/s, and a secondary transfer voltage applied to the secondary transfer apparatus (more specifically, across secondary transfer roller 33 and drive roller 39) is set, for example, to approximately 3000 V. Intermediate transfer belt 30 made of a polyimide film has a thickness, for example, of 130 μm and a volume resistance of approximately 1E3Ω. Ion conductive rubber used for a surface layer of secondary transfer roller 33 has a thickness, for example, of 3 mm and a volume resistance of approximately 1E5Ω.

Electricity removal electrode 62 has a sawtooth shape and is connected to a ground electrode (GND). A distance between electricity removal electrode 62 and paper S is set approximately to 0.1 mm. Electricity removal electrode 62 is made of SUS.

As shown in FIG. 6, when relation between the electrical resistance of paper S and the discharged current is shown with the electrical resistance of the paper being shown on the abscissa and the discharged current being shown on the ordinate, a distribution of electrical resistances of the paper is expressed with a projecting shape having a peak.

In a region where the electrical resistance of the paper is not higher than 1E8Ω, the discharged current abruptly decreases with lowering in electrical resistance of the paper and attains substantially to zero. In the region where the electrical resistance of the paper is not higher than 1E8Ω, even though an amount of current which flows to paper S in the secondary transfer nip portion is large, charges are removed on the front surface and the rear surface of the paper owing to the low electrical resistance of paper S. Therefore, it becomes difficult to hold the charges until the charges reach electricity removal electrode 62 and discharged current decreases.

In a region where the electrical resistance of the paper is from 2E8 to 3E8Ω, the discharged current has a peak, and in a region equal to or higher than that, the discharged current decreases with increase in electrical resistance of the paper. When the electrical resistance of the paper is high, a current which flows to paper S in the secondary transfer nip portion is lowered and hence discharged current decreases.

In general, as the paper has a greater thickness, that is, a lower capacitance, a higher discharged current flows. This is because of a difference in electrostatic distance between the front surface and the rear surface of paper S as described above.

FIG. 7 is a diagram showing one example of a thickness of paper and an electrical resistance of the paper which are specified from a secondary transfer current and a discharged current.

As shown in FIG. 7, when values for the discharged current sensed by second sensing unit 72 are different even though the secondary transfer current sensed by first sensing unit 71 is set to approximately 145 μA, a thickness and an electrical resistance of the paper are also different.

Thus, in the present embodiment, physical properties (a capacitance and an electrical resistance) of paper which have not been specified simply by sensing a secondary transfer current alone can accurately be estimated by sensing the secondary transfer current and the discharged current.

Strictly speaking, a value for the discharged current has a peak with respect to an electrical resistance of paper. Therefore, unless on which side of the peak a value for the discharged current is located can be specified, it may be difficult to uniquely determine physical properties of the paper.

In this case, paper S is transported again and a different secondary transfer voltage is applied across secondary transfer roller 33 and drive roller 30. Then, first sensing unit 71 senses the secondary transfer current and second sensing unit 72 senses the discharged current which flows from paper S to electricity removal electrode 62 after the different secondary transfer voltage is applied.

Influence by a secondary transfer voltage is less in a region where the discharged current lowers due to a low electrical resistance of paper (on the left side of (before) the peak). The discharged current is raised by raising the secondary transfer voltage in the region where the discharged current lowers due to a high electrical resistance of the paper (on the right side of (after) the peak).

Therefore, on which side of the peak a value for the first measured discharged current is located can be distinguished by varying the secondary transfer voltage and sensing how the discharged current varies.

FIG. 8 is a diagram showing one example of a table used in calculation of physical properties of paper in the image formation apparatus according to the embodiment. One example of a table used in calculation of physical properties of paper will be described with reference to FIG. 8.

As shown in FIG. 8, a table to be used in calculation of physical properties of paper is stored in a storage (not shown) of control unit 101.

In the table, a secondary transfer voltage used at the time of sensing, a thickness of paper, a capacitance of the paper, an electrical resistance of the paper, a secondary transfer current, and a discharged current are brought in correspondence with one another. In the table, (V1, T1, Q1, R1, TI1, RI1) to (Vn, Tn, Qn, Rn, TIn, RIn,) are stored as combination of a secondary transfer voltage used at the time of sensing, a thickness of paper, a capacitance of the paper, an electrical resistance of the paper, a secondary transfer current, and a discharged current, where n represents a natural number.

Control unit 101 estimates, by using the table, a capacitance of paper S and an electrical resistance of paper S as physical properties of paper S based on the secondary transfer voltage to be used at the time of sensing, a secondary transfer current sensed by first sensing unit 71, and a discharged current sensed by second sensing unit 72.

Control unit 101 sets a transfer condition for transferring a toner image to paper S based on the estimated capacitance of paper S and electrical resistance of paper S.

The table is prepared by conducting experiments in advance with various conditions being varied. When characteristics of secondary transfer roller 33 and intermediate transfer belt 30 significantly vary owing to an environment such as a temperature and a humidity, a plurality of tables corresponding to respective environments are preferably prepared. The table may be corrected with characteristics between a secondary transfer voltage and a secondary transfer current in the secondary transfer apparatus while paper S is not passed.

Control unit 101 sets a cooling condition of cooling apparatus 80 by using the secondary transfer current sensed by first sensing unit 71 and the discharged current sensed by second sensing unit 72.

Figure 9:
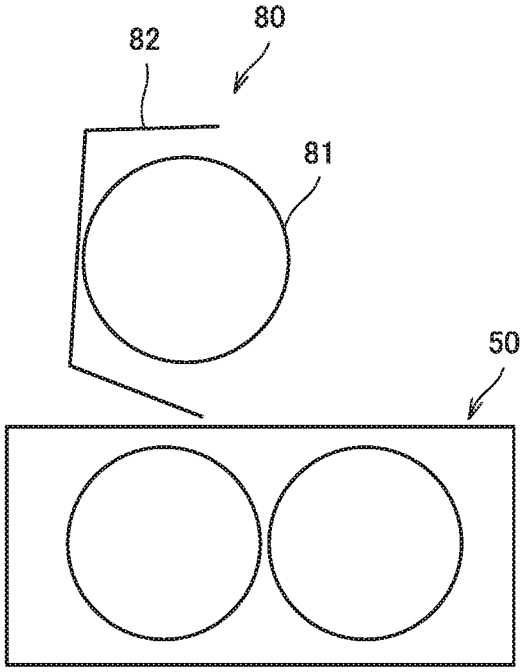
FIG. 9 is a schematic diagram showing a first state of a cooling apparatus according to the embodiment.
Figure 10:
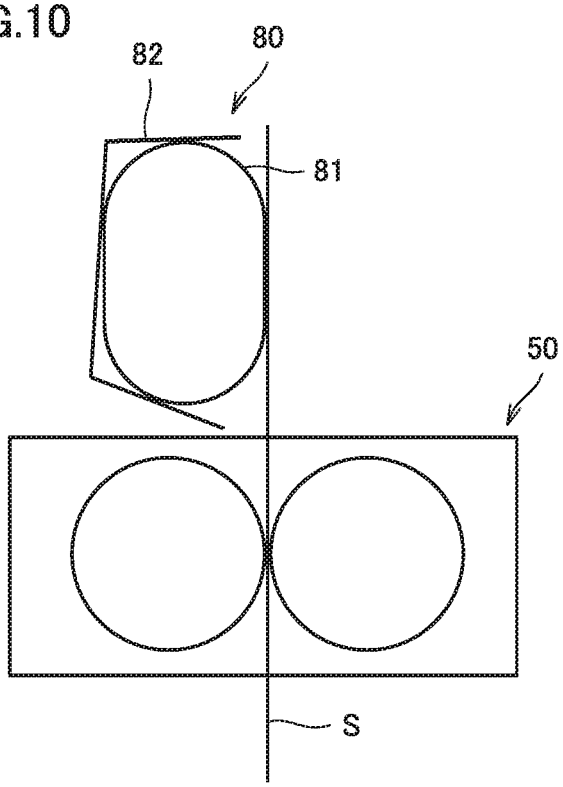
FIG. 10 is a schematic diagram showing a second state of the cooling apparatus according to the embodiment.

FIG. 9 is a schematic diagram showing a first state of the cooling apparatus according to the embodiment. FIG. 10 is a schematic diagram showing a second state of the cooling apparatus according to the embodiment. Cooling apparatus 80 according to the embodiment will be described with reference to FIGS. 9 and 10.

As shown in FIGS. 9 and 10, cooling apparatus 80 is arranged downstream from fixation apparatus 50 in the direction of transportation of paper S. Cooling apparatus 80 cools paper S after a toner image transferred to paper S is fixed.

Cooling apparatus 80 has a cooling portion 81 and a pressing mechanism 82. Cooling portion 81 is cylindrical and air sent from a cooling fan (not shown) passes through the inside of cooling portion 81. Pressing mechanism 82 presses cooling portion 81 against transported paper S.

As shown in FIG. 9, in a first state, cooling portion 81 of cooling apparatus 80 is arranged at a distance from the transportation path for paper S. As shown in FIG. 10, in a second state, cooling portion 81 of cooling apparatus 80 is pressed against paper S located on the transportation path.

Paper S can be cooled by sending air into the inside of cooling portion 81 with the cooling fan while cooling portion 81 is pressed against paper S.

Control unit 101 adjusts an amount of heat absorption from paper S by adjusting a cooling condition such as the number of rotations of the cooling fan and strength of pressing.

Evaporation of moisture from paper S can be suppressed by cooling paper S after fixation. Thus, lowering in transferability to a second surface can be suppressed particularly when paper high in electrical resistance is used. When paper low in electrical resistance is used, paper S does not have to be cooled and cooling apparatus 80 does not have to be used.

Therefore, control unit 101 can reduce waste of energy used for driving cooling apparatus 80 by determining the cooling condition based on the secondary transfer current sensed by first sensing unit 71 and the discharged current sensed by second sensing unit 72.

More specifically, control unit 101 estimates an electrical resistance of paper based on the sensed secondary transfer current and discharged current and increases an amount of heat absorption from paper S by cooling apparatus 80 when the estimated electrical resistance of a recording medium is high.

Cooling apparatus 80 may be implemented by a cooling fan. In this case, control unit 101 changes an amount of heat absorption from paper S by adjusting the number of rotations of the cooling fan. Cooling apparatus 80 may be implemented by a solid metal roller. In this case, an amount of heat absorption from paper S can be varied by adjusting strength of pressing by the metal roller.

FIG. 11 is a diagram showing one example of a secondary transfer current and a discharged current measured with the first sensing unit and the second sensing unit, physical properties of paper calculated from the secondary transfer current and the discharged current, and a transfer condition and a cooling condition determined based on the physical properties of the paper according to the embodiment.

One example of a secondary transfer current and a discharged current, physical properties of paper calculated from the secondary transfer current and the discharged current, and a transfer condition and a cooling condition determined based on the physical properties of the paper is as shown in FIG. 11.

For example, control unit 101 determines a transfer condition and a cooling condition based on the sensed secondary transfer current and discharged current by using a table in which a secondary transfer current and a discharged current, physical properties of paper calculated based on the secondary transfer current and the discharged current, and a transfer condition and a cooling condition determined based on the physical properties of paper are brought in correspondence with one another.

In paper high in electrical resistance, formation of electric field by application of charges to the paper is dominant. It has been known that, when charges are non-uniformly applied, creepage discharging occurs at a paper surface after the paper passes through a transfer nip and image noise is produced. This phenomenon can be suppressed by making charges applied to paper uniform by raising a secondary transfer voltage.

Therefore, in the present embodiment, when an electrical resistance of paper is as high as 6.00E+06, control unit 101 sets a secondary transfer voltage as high as approximately 3300 V to 4000 V. Since paper high in electrical resistance is highly resistant to a relatively high voltage, no problem arises even when the secondary transfer voltage is raised.

When a relatively high voltage is set for paper having an electrical resistance as low as 1.50E+06, noise due to discharging in the paper tends to be produced. Therefore, a secondary transfer voltage is preferably set to a value as low as approximately 3000 V to 3300 V.

In transfer to paper high in electrical resistance, electric field is formed in consideration of magnitude of a capacitance of paper to some extent. A capacitance of normal paper is affected by moisture contained in the paper. In general, moisture is lost due to a high temperature of the paper after fixation in a fixation process by making use of heat. Therefore, when printing on a second surface is performed with a capacitance being lowered, defective transfer tends to occur due to insufficient transfer electric field.

Therefore, in the present embodiment, by cooling paper with cooling apparatus 80 after fixation, decrease in moisture and resulting lowering in capacitance can be suppressed. In particular, lowering in transferability to a second surface can effectively be suppressed by using cooling apparatus 80 when paper having an electrical resistance as high as 6.00E+06 is used.

Even when paper high in electrical resistance is used, an effect of cooling of paper cannot be expected for paper having a capacitance as low as 1.2E-07. Therefore, such paper does not have to be cooled. In this case, a process speed is preferably lowered. For paper having an electrical resistance as low as 1.50E+06, paper S does not have to be cooled and cooling apparatus 80 does not have to be used.

By thus adjusting whether or not to use cooling apparatus 80 and an amount of heat absorption in accordance with physical properties of paper, waste of energy used for driving cooling apparatus 80 can be reduced.

When electric field is formed by applying charges to paper, charges which can be applied simply through a normal transfer process may be restricted by an upper limit of output from a high-voltage power supply. In this case, paper high in electrical resistance may be charged in advance before the paper is subjected to the normal transfer process. By charging paper in advance before the transfer process, transfer quality can be enhanced.

When paper has an intermediate electrical resistance as high as 1.80E+06 and a low capacitance, magnitude of transfer electric field can be ensured by raising a secondary transfer voltage. In this case, when the upper limit of output of the secondary transfer voltage is restricted, it is effective to suppress a process speed, for example, to approximately half. By suppressing the process speed, a time period required for paper to pass through the secondary transfer nip portion is longer and an amount of movement of charges in the paper increases. Consequently, intensity of transfer electric field can be higher.

Since it is not so effective to lower a process speed for paper high in electrical resistance, the paper is preferably charged in advance before the transfer process as described above.

Figure 12:
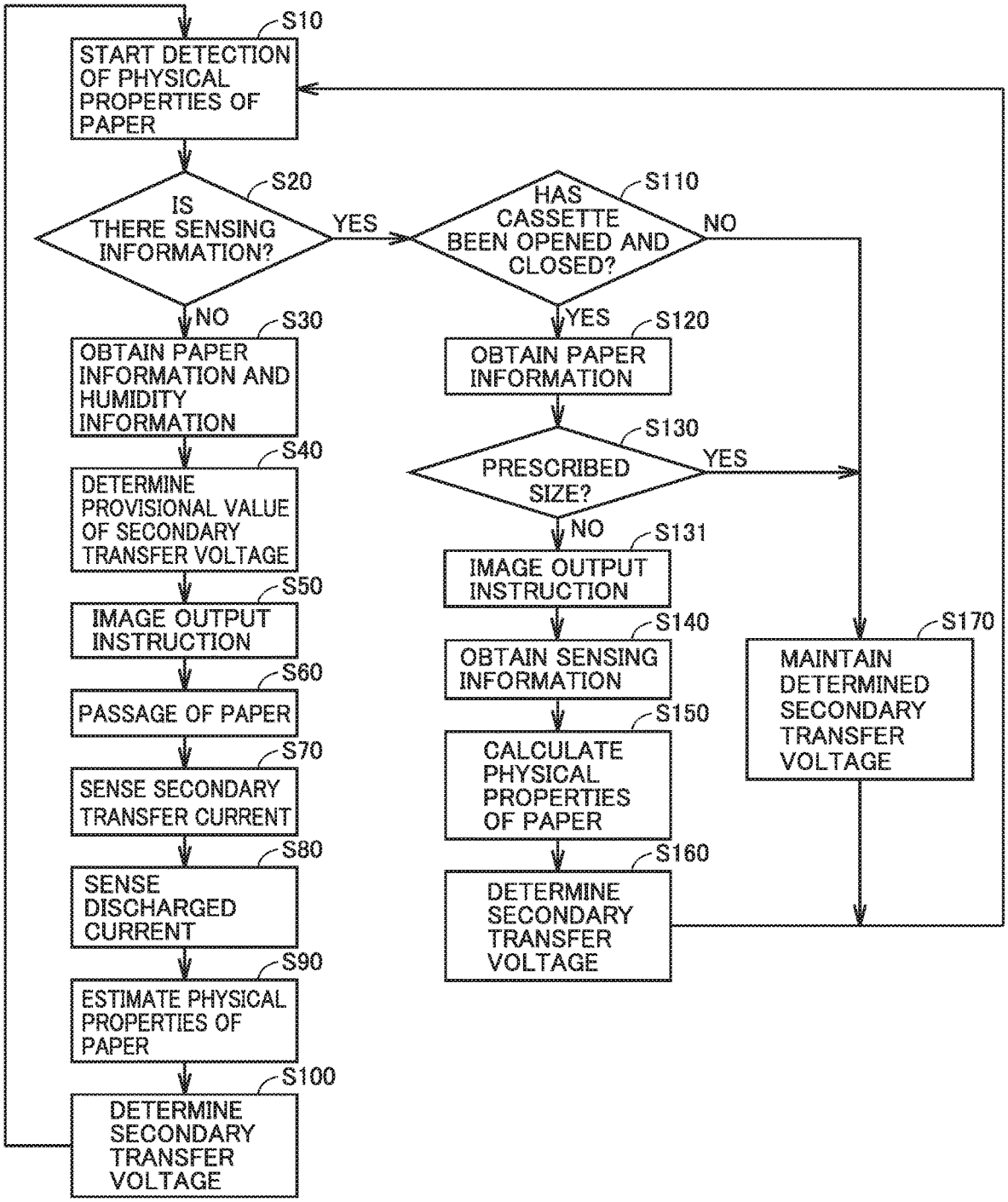
FIG. 12 is a diagram showing a first example of a flow in which a transfer condition is determined in the image formation apparatus according to the embodiment.

FIG. 12 is a diagram showing a first example of a flow in which a transfer condition is determined in the image formation apparatus according to the embodiment. The first example of the flow for determining a transfer condition in image formation apparatus 100 according to the embodiment will be described with reference to FIG. 12.

The transfer condition is determined in printing of an image on a first sheet of paper or a first sheet of paper after change in type of paper. Information on physical properties of paper (a thickness of the paper and a capacitance of the paper) is stored for each cassette.

The first example shows a flow, for example, for determining a transfer condition in printing on a first sheet of paper when the paper accommodated in the cassette has an A4 size and in printing on a first sheet of paper after the size of the paper is changed.

As shown in FIG. 12, in determining a transfer condition, control unit 101 starts detection of physical properties of the paper in step S10. Then, control unit 101 determines in step S20 whether or not there is sensing information resulting from sensing by first sensing unit 71 and second sensing unit 72. Specifically, control unit 101 determines whether or not a secondary transfer current and a discharged current have been sensed. When it is determined that neither of the secondary transfer current and the discharged current has been sensed (step S20: NO), control unit 101 performs step S30. When it is determined that the secondary transfer current and the discharged current have been sensed (step S20: YES), control unit 101 performs step S110.

In step S30, control unit 101 obtains paper information (a width and a thickness of the paper) and humidity information. Control unit 101 obtains information on the paper from information on a cassette that is used and contents set through an operation panel. Control unit 101 obtains the humidity information from a hygrometer.

In step S40, control unit 101 provisionally determines a secondary transfer voltage which is generally considered as proper, based on the paper information and the humidity information obtained in step S30. Control unit 101 uses a table in which relation of the paper information and the humidity information with the secondary transfer voltage is set in advance.

In succession, in step S50, control unit 101 issues an image output instruction. Thus, a toner image corresponding to an image to be output by the image formation portion is formed.

In step S60, control unit 101 has paper S passed from the cassette toward tray 48 along the transportation path.

In succession, a secondary transfer current is sensed in step S70. Specifically, first sensing unit 71 senses a secondary transfer current which flows to the secondary transfer apparatus when paper S passes through the secondary transfer nip portion. The sensed secondary transfer current is input to control unit 101.

A discharged current is sensed in step S80. Specifically, second sensing unit 72 senses a discharged current which flows from paper S charged during passage through the secondary transfer nip portion to electricity removal electrode 62. The sensed discharged current is input to control unit 101.

In succession, in step S90, control unit 101 estimates physical properties of the paper (more specifically, a capacitance of the paper and an electrical resistance of the paper). Control unit 101 estimates the physical properties of the paper by referring to the table in which a secondary transfer voltage used at the time of sensing, a thickness of paper, a capacitance of the paper, an electrical resistance of the paper, a secondary transfer current, and a discharged current are brought in correspondence with one another as described above.

When no table can be referred to, interpolation or extrapolation from a table in the vicinity may be performed as a supplement.

In step S100, control unit 101 determines a secondary transfer voltage as the transfer condition. Control unit 101 determines the secondary transfer voltage based on the estimated capacitance of the paper and electrical resistance of the paper. Control unit 101 may use the table above, or may use an operational expression set in advance to be able to determine a secondary transfer voltage based on the capacitance of the paper and the electrical resistance of the paper.

Though an example in which step S100 is performed next to step S90 has been exemplified and described, limitation thereto is not intended, and step S90 and step S100 may simultaneously be performed.

After step S100 ends, the process returns to step S10. When printing on a second sheet or a subsequent sheet is performed, it is determined in step S20 that there is sensing information (step S20: YES). In this case, step S110 is performed.

Control unit 101 determines in step S110 whether or not the cassette has been opened and closed. When it is determined that the cassette has not been opened and closed (step S110: NO), it is determined that the type of paper has not been changed. In this case, step S170 is performed and the secondary transfer voltage determined in step S100 is maintained.

When it is determined that the cassette has been opened and closed (step S110: YES), it is determined that the type of paper has been changed. In this case, step S120 is performed.

In step S120, control unit 101 obtains information on paper determined to have been changed. In succession, control unit 101 determines in step S130 whether or not paper has a prescribed size based on the obtained information on the paper. In the present flow, whether or not the obtained size of the paper is A4 is determined. As above, information on the paper is obtained from information on a cassette that is used and contents set through the operation panel.

When the size of the paper is determined as the prescribed size (step S130: YES), it is determined that the type of paper was not changed although the cassette was opened and closed, and step S170 is performed. In step S170, the secondary transfer voltage determined in step S100 is maintained as described above.

When the size of the paper is not determined as the prescribed size (step S130: NO), it is determined that the type of the paper has been changed and step S131 is performed.

In step S131, control unit 101 issues an image output instruction. A toner image corresponding to an image to be output by the image formation portion is thus formed.

In step S140, control unit 101 obtains sensing information (a secondary transfer current and a discharged current). Specifically, first sensing unit 71 senses a secondary transfer current which flows to the secondary transfer apparatus when the paper different is size is passed from the cassette toward tray 48 and passes through the secondary transfer nip portion as in step S60, and second sensing unit 72 senses a discharged current which flows from paper S charged during passage through the secondary transfer nip portion to electricity removal electrode 62. The sensed secondary transfer current and discharged current are input to control unit 101.

In succession, in step S150, control unit 101 estimates physical properties of the paper (more specifically, a capacitance of the paper and an electrical resistance of the paper). When a width of the paper does not correspond to A4, an amount of inflow of a current is different for each width of paper in secondary transfer. Therefore, the sensed secondary transfer current is converted to a width corresponding to a lateral width of A4 by using a conversion table for each paper size set in advance. Since a discharged current is in proportion to a width of paper, the sensed discharged current is converted to a value corresponding to a lateral width of A4.

Control unit 101 estimates physical properties of the paper based on the converted values for the secondary transfer current and the discharged current, by referring to the table in which a secondary transfer voltage used at the time of sensing, a thickness of paper, a capacitance of the paper, an electrical resistance of the paper, a secondary transfer current, and a discharged current are brought in correspondence with one another as described above.

In step S160, control unit 101 determines a secondary transfer voltage as the transfer condition. Control unit 101 determines a secondary transfer voltage based on the estimated capacitance of the paper and electrical resistance of the paper. Control unit 101 may use the table above, or may use an operational expression set in advance to be able to determine a secondary transfer voltage based on the capacitance of the paper and the electrical resistance of the paper.

Though an example in which step S160 is performed next to step S150 has been exemplified and described, limitation thereto is not intended, and step S150 and step S160 may simultaneously be performed. After step S160 or step 170 is performed, the process returns to step S10.

Figure 13:
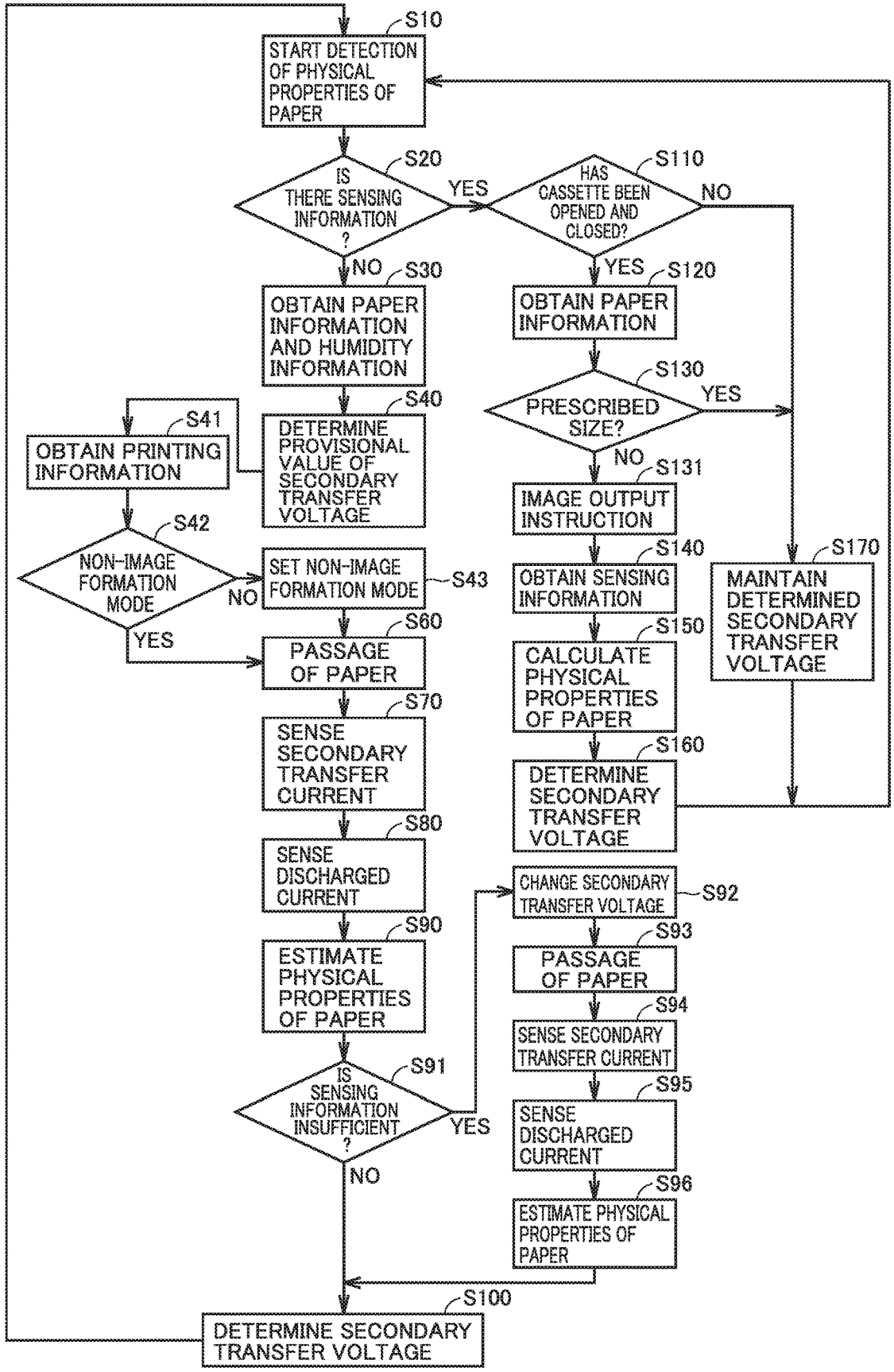
FIG. 13 is a diagram showing a second example of the flow in which a transfer condition is determined in the image formation apparatus according to the embodiment.

FIG. 13 is a diagram showing a second example of the flow in which a transfer condition is determined in the image formation apparatus according to the embodiment. The second example of the flow for determining a transfer condition in image formation apparatus 100 according to the embodiment will be described with reference to FIG. 13.

Though physical properties of paper are estimated at the time of printing of an image in the first example described above, in the second example of the flow for determining a transfer condition, the transfer condition is determined during transportation of a first sheet of paper or a first sheet of paper after change in type of the paper without forming an image.

When coverage of toner formed on the paper is large, a secondary transfer current and a discharged current are affected by charging of toner. Therefore, physical properties of the paper may not accurately be estimated depending on coverage and a humidity.

Physical properties of the paper can accurately be estimated by sensing a secondary transfer current and a discharged current while no image is formed as in the second example.

The second example includes a flow for specifying on which side of the peak in a distribution of electrical resistances of the paper a sensed discharged current is located, with the abscissa representing an electrical resistance of the paper and the ordinate representing a discharged current.

As shown in FIG. 13, the second example of the flow for determining a transfer condition is different from the first example in that steps S41 to S43 are performed between step S40 of provisionally determining a secondary transfer voltage and step S60 of passing the paper instead of step S50 of issuing an image output instruction and steps S91 to S96 are performed between step S90 of estimating physical properties of the paper and step S100 of determining a secondary transfer voltage.

In determining a transfer condition, steps S10 to S40 are performed as in the first example.

In step S41, control unit 101 obtains printing information (image information). Control unit 101 determines whether or not to perform double-sided printing or single-sided printing by obtaining printing information (image information). A method of passage of paper is determined in step S60 which will be described later, based on the printing information indicating either double-sided printing or single-sided printing.

In succession, control unit 101 determines in step S42 whether or not a non-image formation mode has been set. When it is determined that the non-image formation mode has been set (step S42: YES), step S60 is performed. When it is determined that the non-image formation mode has not been set (step S42: NO), step S43 is performed.

In step S43, the non-image formation mode is set. For example, a user selects the non-image formation mode through the operation panel.

In step S60, control unit 101 has paper S passed from the cassette toward tray 48 along the transportation path. When it is determined in step S41 that double-sided printing is to be performed as described above, steps S70 to S90 are performed and thereafter the paper is passed through a path for double-sided printing such that an image can be formed. The paper which has been passed for determining a transfer condition is passed such that the paper can be used again in formation of an image.

When it is determined in step S41 that single-sided printing is to be performed, the paper is passed to be ejected onto tray 48. The paper which has been passed for determining a transfer condition is ejected to tray 48. In this case, an alarm for returning the paper ejected onto tray 48 to the cassette is preferably shown on a display portion of the operation panel.

In succession, steps S70 to S90 are performed as in the first example. Step S91 is performed while or after physical properties of the paper are estimated in step S90.

In step S91, control unit 101 determines whether or not sensing information is insufficient.

When a discharged current sensed by second sensing unit 72 has a value in the vicinity of the peak in the distribution of electrical resistances of the paper, the value is substantially the same on a low resistance side and a high resistance side with respect to the peak, and whether the value of the discharged current is located on the low resistance side or the high resistance side should be determined.

In this case, it is difficult to accurately estimate physical properties of the paper simply based on the secondary transfer current sensed by first sensing unit 71 and control unit 101 determines that the sensing information is insufficient. Specifically, for example, when the sensed discharged current is within a range not lower than 80% of the peak value, control unit 101 determines that the sensing information is insufficient. When the sensed discharged current has a value distant from the peak value, for example, when the sensed discharged current is lower than 80% of the peak value, it is determined that the sensing information is sufficient.

When it is determined that the sensing information is sufficient (step S91: NO), step S100 is performed.

When it is determined that the sensing information is insufficient (step S91: YES), step S92 is performed. In step S92, control unit 101 changes a secondary transfer voltage. For example, control unit 101 raises the secondary transfer voltage by several hundred V.

In step S93, control unit 101 has paper S passed from the cassette toward tray 48 along the transportation path. When it is determined that double-sided printing is to be performed as above, the paper which has been passed in step S60 is again passed. When it is determined that single-sided printing is to be performed as above, the paper which has been ejected to tray 48 and returned to the cassette is passed.

When the paper ejected to tray 48 has not been returned to the cassette, a next sheet of paper may be passed.

In succession, a secondary transfer current is sensed in step S94. Specifically, first sensing unit 71 senses a secondary transfer current which flows to the secondary transfer apparatus when paper S passes through the secondary transfer nip portion. The sensed secondary transfer current is input to control unit 101.

A discharged current is sensed in step S95. Specifically, second sensing unit 72 senses a discharged current which flows from paper S charged during passage through the secondary transfer nip portion to electricity removal electrode 62. The sensed discharged current is input to control unit 101.

In succession, in step S96, control unit 101 estimates physical properties of paper (more specifically, a capacitance of the paper and an electrical resistance of the paper).

When the secondary transfer voltage has been changed, in a region where a discharged current lowers (on the left side of (before) the peak) due to a low electrical resistance of the paper, the discharged current is less likely to be affected by the secondary transfer voltage, whereas the discharged current is raised if the secondary transfer voltage is raised in a region (on the right of (after) the peak) where the discharged current lowers due to a high electrical resistance of the paper.

Therefore, by sensing how the discharged current varies in response to variation in secondary transfer voltage, on which side of the peak a value for the first measured discharged current is located can be distinguished.

Control unit 101 makes distinction above and estimates physical properties of the paper by referring to the table in which a secondary transfer voltage used at the time of sensing, a thickness of paper, a capacitance of the paper, an electrical resistance of the paper, a secondary transfer current, and a discharged current are brought in correspondence with one another.

Control unit 101 determines in step S100 a secondary transfer voltage as the transfer condition.

Control unit 101 determines a secondary transfer voltage based on the estimated capacitance of the paper and electrical resistance of the paper. Control unit 101 may use the table above, or may use an operational expression set in advance to be able to determine a secondary transfer voltage based on the capacitance of the paper and the electrical resistance of the paper.

Though the second example in which when it is determined that sensing information is sufficient in step S91, only first sensing information (a secondary transfer current and a discharged current sensed first) is used to determine a secondary transfer voltage has been exemplified and described, limitation thereto is not intended. On which side of the peak a value for a first measured discharged current is located may be distinguished by measuring a secondary transfer current and a discharged current in forming an image by passing paper after determination of a secondary transfer voltage and sensing how the discharged current varies. After such distinction is made, physical properties of the paper may be estimated and a secondary transfer voltage may be determined as the transfer condition in next or subsequent printing.

Figure 14:
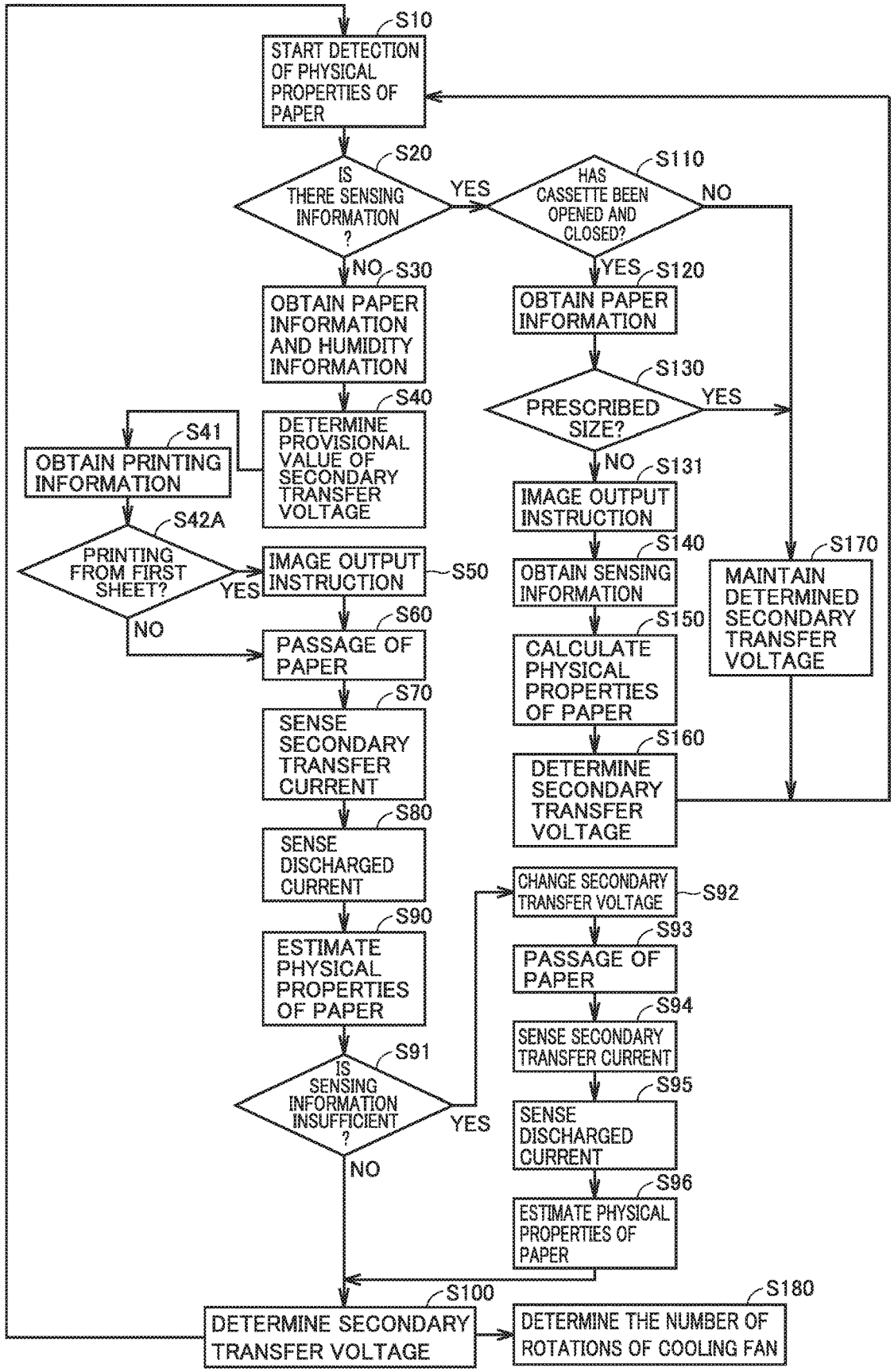
FIG. 14 is a diagram showing a third example of the flow in which a transfer condition and a cooling condition are determined in the image formation apparatus according to the embodiment.

FIG. 14 is a diagram showing a third example of the flow in which a transfer condition and a cooling condition are determined in the image formation apparatus according to the embodiment. The third example of the flow for determining a transfer condition and a cooling condition in image formation apparatus 100 according to the embodiment will be described with reference to FIG. 14.

Though a transfer condition is determined by sensing a secondary transfer current and a discharged current for determining a transfer condition in the non-image formation mode in the second example described above, in the third example of the flow for determining a transfer condition and a cooling condition, a transfer condition and a cooling condition are determined by sensing a secondary transfer current and a discharged current for determining a transfer condition in an image formation mode.

As shown in FIG. 14, the third example is different from the second example in that steps S42A and S50 are performed instead of steps S42 and S43 and step S180 is further performed after step S100.

In the third example, in determining a transfer condition and a cooling condition, steps S10 to S41 are performed as in the second example.

Control unit 101 determines in step S42A whether or not to perform printing from a first sheet. Control unit 101 determines whether or not an image formation mode in which an image is formed on paper S has been set.

When it is determined that printing is to be performed from a first sheet (step S42A: YES), step S50 is performed. In step S50, control unit 101 issues an image output instruction. A toner image corresponding to an image to be output by the image formation portion is thus formed. In succession, step S60 and subsequent steps are performed as in the second example.

When it is determined that printing is not to be performed from a first sheet (step S42A: NO), it is determined that a transfer condition and a cooling condition are determined in the non-image formation mode. In this case, step S60 and subsequent steps are performed as in the second example.

After step S100 of determining a secondary transfer voltage, step S180 is performed. Step S180 may be performed simultaneously with step S100.

Control unit 101 determines in step S180 the number of rotations of a cooling fan as the cooling condition. Specifically, control unit 101 estimates an electrical resistance of the paper based on the sensed secondary transfer current and discharged current, and when the estimated electrical resistance of the paper is high, the control unit increases an amount of heat absorption from paper S by cooling apparatus 80.

Evaporation of moisture from paper S can be suppressed by cooling paper S after fixation. Lowering in transferability to a second surface particularly when paper high in electrical resistance is used can thus be suppressed.

When an electrical resistance of the paper is low, control unit 101 determines, for example, that cooling of paper S is not necessary, and the control unit lowers the number of rotations of the cooling fan or turns off the cooling fan. Power consumption can thus be reduced.

FIG. 15 is a diagram showing one example of a table that is used in determining physical properties of paper, a transfer condition, and a cooling condition based on a secondary transfer current and a discharged current sensed by the first sensing unit and the second sensing unit according to the embodiment.

As described above, when the number of rotations of the cooling fan is determined in step S180 as the cooling condition, for example, a table as shown in FIG. 15 in which sensed secondary transfer current and discharged current, a capacitance of paper, an electrical resistance of the paper, a secondary transfer voltage as the transfer condition, and the number of rotations of the cooling fan as the cooling condition are brought in correspondence with one another is used.

Control unit 101 sets as appropriate the number of rotations of the cooling fan in accordance with the sensed discharged current even though the sensed secondary transfer current has a prescribed value (the same value). Control unit 101 sets as appropriate the number of rotations of the cooling fan in accordance with the sensed secondary transfer current even though the sensed discharged current has a prescribed value (the same value). A cooling condition can thus appropriately be set.

Figure 16:
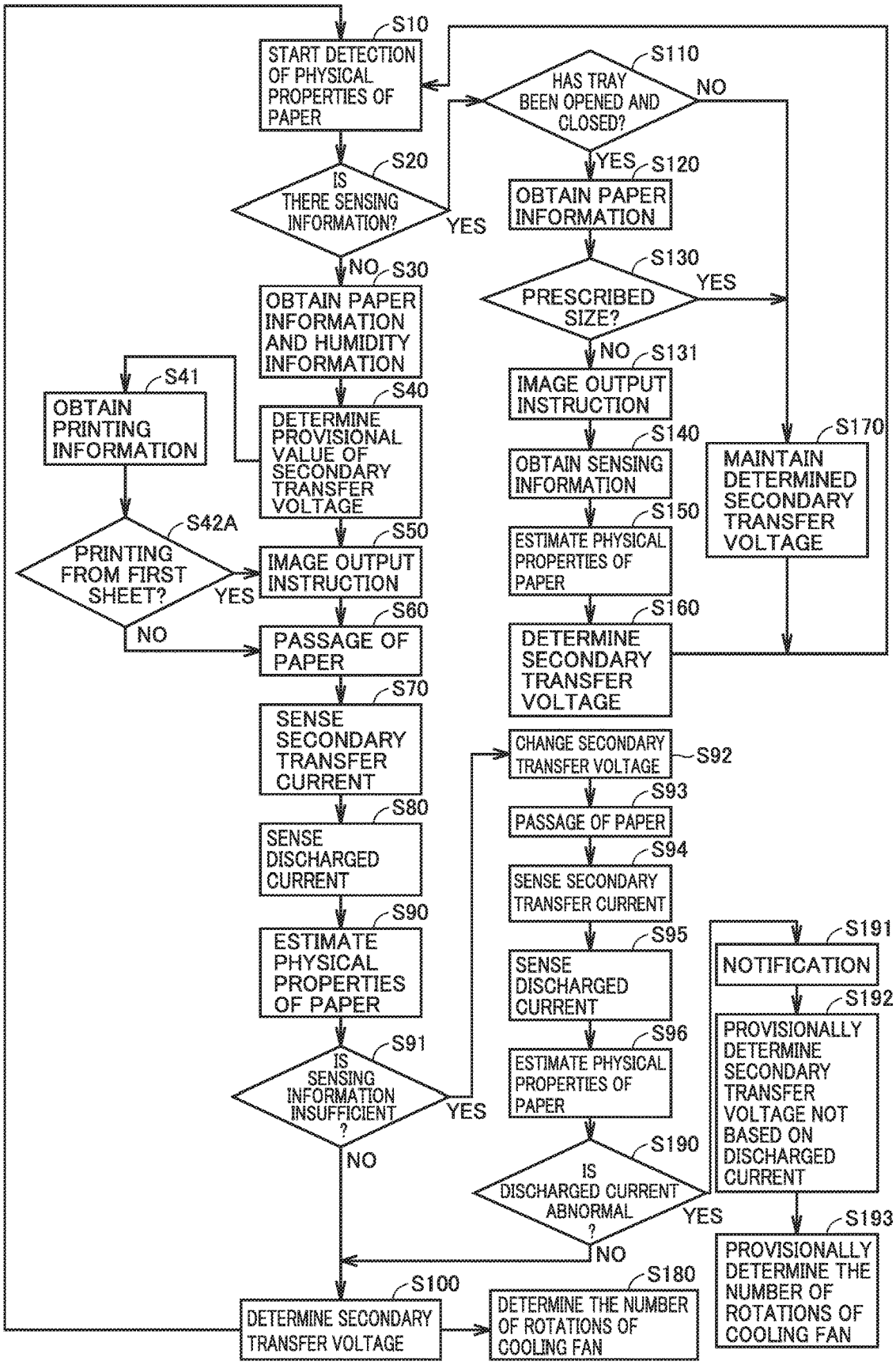
FIG. 16 is a diagram showing a fourth example of the flow in which a transfer condition and a cooling condition are determined in the image formation apparatus according to the embodiment.

FIG. 16 is a diagram showing a fourth example of the flow in which a transfer condition and a cooling condition are determined in the image formation apparatus according to the embodiment. The fourth example of the flow for determining a transfer condition and a cooling condition in image formation apparatus 100 according to the embodiment will be described with reference to FIG. 16.

The fourth example of the flow for determining a transfer condition and a cooling condition is mainly different from the third example in that a discharged current sensed in step S95 after change in secondary transfer voltage in step S92 and a discharged current sensed in step S80 before change in secondary transfer voltage are compared with each other, and when an abnormal condition is sensed, notification of the abnormal condition is given.

A secondary transfer current can automatically be corrected in accordance with an environment and a resistance of a roller by applying a bias when no paper is passed. Therefore, when a secondary transfer current is abnormal, such an abnormal condition can be sensed at the time of correction.

An abnormal condition of a discharged current, however, cannot be sensed while no paper is passed. Unless physical properties of paper are known, it is difficult to sense an abnormal condition only with a measured discharged current even though paper is passed. Since a discharged current is less likely to flow when an electrical resistance of paper is low, one may not be able to distinguish whether such a situation is caused by an abnormal condition or a low resistance of the paper. Examples of the abnormal condition in discharged current include poor conduction due to paper dust and a foreign matter.

Since physical properties of paper are estimated based on sensed values of both of a secondary transfer current and a discharged current in the present embodiment, when an abnormal condition of a discharged current occurs, physical properties of paper may erroneously be estimated. In the fourth example, the flow allowing sensing of an abnormal condition of a discharged current as described above is provided.

Specifically, in the fourth example, when a discharged current sensed by second sensing unit 72 at the time of application of a higher voltage of secondary transfer voltages different from each other applied before and after change is equal to or lower than a discharged current sensed by second sensing unit 72 at the time of application of a lower voltage of the secondary transfer voltages different from each other, a notification portion provided in the image formation apparatus gives a notification of the abnormal condition.

In the fourth example, when the notification portion gives a notification about the abnormal condition, image formation processing is stopped or a secondary transfer voltage is set only based on a secondary transfer current sensed by first sensing unit 71.

As shown in FIG. 16, the fourth example is different from the third example in that steps S191 to S193 are performed.

In the fourth example, in determining a transfer condition and a cooling condition, steps S10 to S96 are performed as in the third example.

When step S96 is performed, step S190 is performed. Control unit 101 determines in step S190 whether or not an abnormal condition of a discharged current has occurred. Specifically, control unit 101 determines whether or not a discharged current sensed by second sensing unit 72 at the time of application of a higher voltage of secondary transfer voltages different from each other applied across secondary transfer roller 33 and drive roller 39 is higher than a discharged current sensed by second sensing unit 72 at the time of application of a lower voltage of the secondary transfer voltages different from each other.

When the discharged current sensed at the time of application of a higher voltage of the secondary transfer voltages different from each other is higher than the discharged current sensed at the time of application of a lower voltage of the secondary transfer voltages different from each other, it is determined that no abnormal condition has occurred.

When the discharged current sensed at the time of application of a higher voltage of the secondary transfer voltages different from each other is not higher than the discharged current sensed at the time of application of a lower voltage of the secondary transfer voltages different from each other, it is determined that an abnormal condition has occurred.

When it is determined that an abnormal condition of a discharged current has not occurred (step S190: NO), step S100 is performed.

When it is determined that an abnormal condition of a discharged current has occurred (step S190: YES), step S191 is performed.

In step S191, the notification portion gives a notification of an abnormal condition of the discharged current. Specifically, an indication of an abnormal condition is provided on a display panel or a notification of an abnormal condition is given to a maintenance service provider through wired or wireless communication.

In step S192, a secondary transfer voltage is provisionally determined only based on a value for a secondary transfer current sensed by first sensing unit 71 without using a sensed value for the discharged current. In succession, in step S193, the number of rotations of the cooling fan is provisionally determined.

Steps S192 and S193 may simultaneously be performed and steps S191, S192, and S193 may also simultaneously be performed.

As set forth above, by setting a transfer condition for transferring a toner image to a recording medium based on a secondary transfer current sensed by first sensing unit 71 and a discharged current sensed by second sensing unit 72, the image formation apparatus according to the present embodiment can set a transfer condition more accurately than in an example in which a transfer condition is set by sensing any one of a secondary transfer current and a discharged current.

In setting a transfer condition, by estimating an electrical resistance and a capacitance of paper based on the sensed secondary transfer current and discharged current and setting a transfer condition based on the estimated electrical resistance and capacitance of the paper, a transfer condition which is difficult to uniquely be determined based on only one of the electrical resistance and the capacitance of paper can accurately be set.

Though an example in which a first electrode portion including a contact electrode in contact with transported paper and a counter electrode arranged to be opposed to the contact electrode such that the transported paper lies between the contact electrode and the counter electrode is implemented by the secondary transfer apparatus has been exemplified and described in the present embodiment, limitation thereto is not intended.

So long as a voltage can be applied across the contact electrode and the counter electrode while the paper lies between the contact electrode and the counter electrode, the contact electrode and the counter electrode may be in a form of a plate or in a form of a roller. In this case, the contact electrode and the counter electrode may be arranged upstream or downstream from the secondary transfer apparatus in the direction of transportation of paper.

When the first electrode portion is implemented by the secondary transfer apparatus as described above, the number of components can be reduced.

Though an example in which the second electrode portion arranged as not being in contact with paper such that charges applied to paper are movable is implemented by an electricity removal electrode has been exemplified and described, limitation thereto is not intended and modification as appropriate within the scope not departing from the gist of the present invention can be made.

The image formation apparatus based on the present invention described above includes a first electrode portion including a contact electrode and a counter electrode, the contact electrode being in contact with a transported recording medium, the counter electrode being arranged to be opposed to the contact electrode such that the transported recording medium lies between the contact electrode and the counter electrode, a second electrode portion arranged as not being in contact with the recording medium such that charges applied to the recording medium are movable, a first sensing unit configured to sense a first current which flows to the first electrode portion as a result of application of a voltage across the contact electrode and the counter electrode while the recording medium lies between the contact electrode and the counter electrode, a second sensing unit configured to sense a second current which flows from the charged recording medium to the second electrode portion, and a control unit configured to receive input of results of sensing by the first sensing unit and the second sensing unit. The control unit is configured to set a transfer condition for transferring a toner image to the recording medium based on the first current sensed by the first sensing unit and the second current sensed by the second sensing unit.

In the image formation apparatus based on the present invention, the control unit preferably estimates an electrical resistance and a capacitance of the recording medium based on the sensed first current and the sensed second current and preferably sets the transfer condition based on the estimated electrical resistance and capacitance of the recording medium.

In the image formation apparatus based on the present invention, preferably, the first electrode portion is implemented by a transfer apparatus configured to transfer the toner image carried on a toner image carrier to the recording medium.

In the image formation apparatus based on the present invention, preferably, the second electrode portion is implemented by an electricity removal electrode which removes charges applied to the recording medium.

In the image formation apparatus based on the present invention, preferably, the second electrode portion is arranged downstream from the first electrode portion in a direction of transportation of the recording medium.

In the image formation apparatus based on the present invention, when relation between an electrical resistance of the recording medium and the second current is shown with the electrical resistance of the recording medium being shown on an abscissa and the second current being shown on an ordinate, a distribution of electrical resistances of the recording medium may be expressed with a projecting shape having a peak. In this case, preferably, when the sensed second current has a value in a region around the peak, the control unit sets the transfer condition based on the first current sensed by the first sensing unit as a result of application of different voltages across the contact electrode and the counter electrode and the second current which flows from the recording medium to the second electrode portion after application of the different voltages and is sensed by the second sensing unit.

The image formation apparatus based on the present invention may further include a notification portion which gives a notification about an abnormal condition when the second current sensed by the second sensing unit at the time of application of a higher voltage of the different voltages applied across the contact electrode and the counter electrode is not higher than the second current sensed by the second sensing unit at the time of application of a lower voltage of the different voltages applied to the first electrode portion.

In the image formation apparatus based on the present invention, preferably, when the notification portion gives the notification about the abnormal condition, the control unit stops image formation processing or sets the transfer condition only based on the first current sensed by the first sensing unit.

In the image formation apparatus based on the present invention, preferably, the control unit sets the transfer condition based on the first current sensed by the first sensing unit and the second current sensed by the second sensing unit when printing is performed on a first sheet of the recording medium or a first sheet of the recording medium after change in type of the recording medium.

In the image formation apparatus based on the present invention, the control unit may set the transfer condition based on the first current sensed by the first sensing unit and the second current sensed by the second sensing unit in transporting a first sheet of the recording medium or a first sheet of the recording medium after change in type of the recording medium without forming an image.

In the image formation apparatus based on the present invention, preferably, the control unit estimates an electrical resistance and a capacitance of the recording medium based on the sensed first current and the sensed second current. In this case, the control unit preferably raises a transfer voltage to be applied to the transfer apparatus in transfer of the toner image from a toner image carrier to the recording medium when the estimated electrical resistance of the recording medium is high, and lowers the transfer voltage when the capacitance of the recording medium is high.

The image formation apparatus based on the present invention may further include a cooling apparatus configured to cool the recording medium after the toner image transferred to the recording medium is fixed. In this case, preferably, the control unit sets a cooling condition of the cooling apparatus based on the first current sensed by the first sensing unit and the second current sensed by the second sensing unit.

In the image formation apparatus based on the present invention, preferably, the control unit estimates an electrical resistance of the recording medium based on the sensed first current and the sensed second current. In this case, the control unit preferably increases an amount of heat absorption from the recording medium by the cooling apparatus when the estimated electrical resistance of the recording medium is high.

Although embodiments of the present invention have been described and illustrated in detail, the disclosed embodiments are made for the purposes of illustration and example only and not limitation. The scope of the present invention should be interpreted by terms of the appended claims.

What is claimed is:

1. An image formation apparatus comprising:

a first electrode portion including a contact electrode and a counter electrode, the contact electrode being in contact with a transported recording medium, the counter electrode being arranged to be opposed to the contact electrode such that the transported recording medium lies between the contact electrode and the counter electrode;

a second electrode portion arranged as not being in contact with the recording medium such that charges applied to the recording medium are movable;

a first sensing unit configured to sense a first current which flows to the first electrode portion as a result of application of a voltage across the contact electrode and the counter electrode while the recording medium lies between the contact electrode and the counter electrode;

a second sensing unit configured to sense a second current which flows from the charged recording medium to the second electrode portion; and a control unit configured to receive input of results of sensing by the first sensing unit and the second sensing unit, the control unit being configured to set a transfer condition for transferring a toner image to the recording medium based on the first current sensed by the first sensing unit and the second current sensed by the second sensing unit, wherein the second electrode portion is arranged downstream from the first electrode portion in a direction of transportation of the recording medium, when relation between an electrical resistance of the recording medium and the second current is shown with the electrical resistance of the recording medium being shown on an abscissa and the second current being shown on an ordinate, a distribution of electrical resistances of the recording medium is expressed with a projecting shape having a peak, and when the sensed second current has a value in a region around the peak, the control unit is configured to set the transfer condition based on the first current sensed by the first sensing unit as a result of application of different voltages across the contact electrode and the counter electrode and the second current which flows from the recording medium to the second electrode portion after application of the different voltages and is sensed by the second sensing unit.

2. The image formation apparatus according to claim 1, the image formation apparatus further comprising a notification portion configured to give a notification about an abnormal condition when the second current sensed by the second sensing unit in application of a higher voltage of the voltages different from each other applied across the contact electrode and the counter electrode is not higher than the second current sensed by the second sensing unit in application of a lower voltage of the voltages different from each other applied to the first electrode portion.

3. The image formation apparatus according to claim 2, wherein when the notification portion gives the notification about the abnormal condition, the control unit is configured to stop image formation processing or to set the transfer condition only based on the first current sensed by the first sensing unit.

4. An image formation apparatus comprising:

a first electrode portion including a contact electrode and a counter electrode, the contact electrode being in contact with a transported recording medium, the counter electrode being arranged to be opposed to the contact electrode such that the transported recording medium lies between the contact electrode and the counter electrode;

a second electrode portion arranged as not being in contact with the recording medium such that charges applied to the recording medium are movable;

a first sensing unit configured to sense a first current which flows to the first electrode portion as a result of application of a voltage across the contact electrode and the counter electrode while the recording medium lies between the contact electrode and the counter electrode;

a second sensing unit configured to sense a second current which flows from the charged recording medium to the second electrode portion; and a control unit configured to receive input of results of sensing by the first sensing unit and the second sensing unit, the control unit being configured to set a transfer condition for transferring a toner image to the recording medium based on the first current sensed by the first sensing unit and the second current sensed by the second sensing unit, wherein the control unit is configured to calculate an electrical resistance and a capacitance of the recording medium based on the sensed first current and the sensed second current, and to raise a transfer voltage to be applied to the transfer apparatus in transfer of the toner image from a toner image carrier to the recording medium when the estimated electrical resistance of the recording medium is high and to lower the transfer voltage when the capacitance of the recording medium is high.

5. An image formation apparatus comprising:

a first electrode portion including a contact electrode and a counter electrode, the contact electrode being in contact with a transported recording medium, the counter electrode being arranged to be opposed to the contact electrode such that the transported recording medium lies between the contact electrode and the counter electrode;

a second electrode portion arranged as not being in contact with the recording medium such that charges applied to the recording medium are movable;

a first sensing unit configured to sense a first current which flows to the first electrode portion as a result of application of a voltage across the contact electrode and the counter electrode while the recording medium lies between the contact electrode and the counter electrode;

a second sensing unit configured to sense a second current which flows from the charged recording medium to the second electrode portion;

a control unit configured to receive input of results of sensing by the first sensing unit and the second sensing unit, the control unit being configured to set a transfer condition for transferring a toner image to the recording medium based on the first current sensed by the first sensing unit and the second current sensed by the second sensing unit; and a cooling apparatus configured to cool the recording medium after the toner image transferred to the recording medium is fixed, wherein the control unit is configured to set a cooling condition of the cooling apparatus based on the first current sensed by the first sensing unit and the second current sensed by the second sensing unit.

6. The image formation apparatus according to claim 5, wherein the control unit is configured to calculate an electrical resistance of the recording medium based on the sensed first current and the sensed second current and to increase an amount of heat absorption from the recording medium by the cooling apparatus when the calculated electrical resistance of the recording medium is high.

* * * * *